US010859312B2

(12) United States Patent
Waltzing

(10) Patent No.: US 10,859,312 B2
(45) Date of Patent: Dec. 8, 2020

(54) PORTABLE REFRIGERATION CANISTER

(71) Applicant: Paul W. Waltzing, San Gwann (MT)

(72) Inventor: Paul W. Waltzing, San Gwann (MT)

( * ) Notice: Subject to any disclaimer, the term of this patent is extended or adjusted under 35 U.S.C. 154(b) by 259 days.

(21) Appl. No.: 16/206,492

(22) Filed: Nov. 30, 2018

(65) Prior Publication Data

US 2019/0257577 A1 Aug. 22, 2019

Related U.S. Application Data

(60) Provisional application No. 62/633,114, filed on Feb. 21, 2018.

(51) Int. Cl.

| | |
|---|---|
| ***F25D 31/00*** | (2006.01) |
| ***B65D 81/18*** | (2006.01) |
| ***F25B 9/00*** | (2006.01) |
| ***F25B 21/02*** | (2006.01) |
| ***F25B 31/02*** | (2006.01) |
| ***F25B 9/04*** | (2006.01) |
| *F25B 27/00* | (2006.01) |
| *F25D 11/00* | (2006.01) |

(52) U.S. Cl.

CPC ..... *F25D 31/007* (2013.01); *B65D 81/18* (2013.01); *F25B 9/004* (2013.01); *F25B 9/04* (2013.01); *F25B 21/02* (2013.01); *F25B 31/02* (2013.01); *F25B 27/00* (2013.01); *F25B 31/023* (2013.01); *F25B 2321/021* (2013.01); *F25B 2321/023* (2013.01); *F25B 2341/001* (2013.01); *F25B 2341/0011* (2013.01); *F25B 2341/0012* (2013.01); *F25B 2341/0014* (2013.01); *F25D 11/00* (2013.01); *F25D 31/00* (2013.01); *F25D 31/006* (2013.01); *F25D 2331/809* (2013.01)

(58) Field of Classification Search

CPC ..... F25D 31/007; F25D 11/00; F25D 31/006; F25D 31/00; F25D 2331/809; B65D 81/18; F25B 9/004; F25B 21/02; F25B 31/02; F25B 9/04; F25B 2321/023; F25B 2321/021; F25B 31/023; F25B 2341/001; F25B 2341/0011; F25B 2341/0012; F25B 2341/0014; F25B 27/00

See application file for complete search history.

(56) References Cited

U.S. PATENT DOCUMENTS

| | | | | |
|---|---|---|---|---|
| 1,952,281 | A | 3/1934 | Ranque | |
| 2,770,103 | A | 11/1956 | Florea | |
| 4,096,707 | A | 6/1978 | Taylor | |
| 4,193,525 | A | 3/1980 | Sommers | |
| 4,955,516 | A | 9/1990 | Satterfield | |
| 5,901,572 | A * | 5/1999 | Peiffer | B60H 1/32014 62/480 |

(Continued)

*Primary Examiner* — David J Teitelbaum
*Assistant Examiner* — Heather J Huddle
(74) *Attorney, Agent, or Firm* — Louis Ventre, Jr.

(57) ABSTRACT

A portable refrigeration container is usable for cooling a bottle of drinkable fluid. It includes a tubular body, a vortex tube, an electronic programmable controller, a tank of compressed air, a battery, a Peltier device, a heat exchanger, and a removable electrical charging station. Optionally, the portable refrigeration container further includes a compressor, a dynamo, and a bracket for attachment to a bicycle frame. The optional compressor and dynamo that electrically recharges the battery, may share a single shaft that is rotatably connected to turn with a bicycle wheel.

5 Claims, 7 Drawing Sheets

(56) References Cited

U.S. PATENT DOCUMENTS

| | | | | |
|---|---|---|---|---|
| 6,119,461 | A | 9/2000 | Stevick et al. | |
| 6,269,653 | B1 * | 8/2001 | Katusa | F25D 11/00 62/238.2 |
| 6,523,364 | B1 * | 2/2003 | Pader | F25D 31/007 62/238.2 |
| 6,595,016 | B1 * | 7/2003 | Demirkiran | A01K 5/0114 62/236 |
| 7,475,563 | B2 * | 1/2009 | McCarrell | F25D 3/08 62/420 |
| 8,366,920 | B2 * | 2/2013 | Davis | B67D 3/0032 210/86 |
| 8,616,010 | B2 | 12/2013 | Bakos | |
| 9,168,964 | B1 * | 10/2015 | Lee | B62J 6/04 |
| 10,358,046 | B2 * | 7/2019 | Myers | B60K 11/02 |

* cited by examiner

PORTABLE REFRIGERATION CANISTER

CROSS-REFERENCE TO RELATED APPLICATIONS

This application claims the benefit of U.S. Provisional Application No. 62/633,114, filed 21 Feb. 2018, which is hereby incorporated by reference herein.

TECHNICAL FIELD

In the field of refrigeration, a portable apparatus removes heat from an inner container configured to hold a bottle or can of drinkable fluid. For simplicity the bottle or can is referred to herein as the bottle. Refrigeration is enabled by compressed air flowing along a stationary curvilinear path under pressure, producing a cooling effect, and further enabled by a solid state Peltier device, the compressor and the Peltier device powered by a battery. The apparatus may be adapted for attachment to a bicycle and configured so that wheel rotation provides for compressed air and battery recharging.

BACKGROUND ART

Bicyclists often carry bottles of water or other drinks to hydrate on long trips. Typically, the bottles start out chilled having been extracted from a fixed refrigerator location and are then carried with the expectation that the drink will eventually warm during the cycling trip. Insulated containers are sometimes used to slow the warming process.

The portable refrigeration device described herein uses a vortex tube, first described in the early 1930's and patented in U.S. Pat. No. 1,952,281. In order to develop a practical, light weight and small-sized, cooler in the present application, the vortex tube is paired with a Peltier device in a unique configuration.

The vortex tube, also known as a Ranque-Hilsch vortex tube, is a mechanical device that separates a compressed gas into hot and cold streams. The compressed gas, which in preferred embodiments, is air, is injected tangentially into a swirl chamber and accelerated to a high rate of rotation. Due to a conical nozzle at the end of the tube, only the outer shell of the compressed gas is allowed to escape at that end. The remainder of the gas is forced to return in an inner vortex of reduced diameter within the outer vortex. Other than air flow, the vortex tube has no moving parts.

The Peltier device is essentially a solid state thermoelectric cooling device. The Peltier effect causes a heat flux between the junction of two different types of materials. The Peltier device transfers heat from one side of the device to the other when a voltage is applied across the device. Varying the current flowing through the Peltier device by changing the voltage across the device varies the cooling effect.

SUMMARY OF INVENTION

A portable refrigeration container is usable for cooling a bottle of drinkable fluid. It includes a tubular body, a vortex tube, an electronic programmable controller, a tank of compressed air, a battery, a Peltier device, a heat exchanger, and a removable electrical charging station. Optionally, the portable refrigeration container further includes a compressor, a dynamo, and a bracket for attachment to a bicycle frame. The tubular body has an open top end and a plate forming a bottom end. The plate has a central through-hole which holds the Peltier device. The vortex tube has a compressed air input line, an output cool air line flowably connected to the inner volume, and an outlet valve exhausting hot air to the external environment. The electronic programmable controller opens and closes a valve on the output cool air line between the vortex tube and the inner volume. The tank of compressed air is valved so as to permit compressed air to flow from the tank into the compressed air input line as controlled by the electronic programmable controller. The battery is connected to supply electrical power to the electronic programmable controller. The heat exchanger is in contact with the lower surface of the Peltier device so as to enhance heat transfer away from the lower surface of the Peltier device. The removable electrical charging station is situated below a fan and configured to recharge the battery upon connection to an outside electrical supply line. The optional compressor supplies compressed air to the tank of compressed air. The optional dynamo electrically recharges the battery and may share a single shaft that is rotatably connected to turn with a bicycle wheel. The bracket attaches the portable refrigeration container to a bicycle frame.

Technical Problem

The need for light-weight and portable cooling systems that can be used outdoors in active sports conditions for maintaining a chilled drink. This need has not been satisfied heretofore because refrigeration typically involves large, relatively heavy, devices that consume significant amounts of energy.

There is a need to refrigerate and have access to cold drinks on any occasion, whilst engaged in sports or cycling. This need requires a refrigeration device that is small, and sufficiently light in weight, to be attached to a bicycle and used to maintain a chilled drink.

Solution to Problem

The solution is a lightweight, portable and compact electromechanical refrigeration system for cooling a bottle of drinkable fluid using compressed air and a battery pack for untethered use. The refrigeration system is especially configured to be attached to a bicycle with optional components that permit bicycle wheel rotation to recharge a battery and maintain a full tank of compressed air.

Advantageous Effects of Invention

The portable refrigeration container enables a user on a bicycle to chill a drink and then use the chilled drink to remain hydrated.

The portable refrigeration container enables a user in other endeavors to carry with them and have a chilled drink whenever and wherever they want.

BRIEF DESCRIPTION OF DRAWINGS

The drawings illustrate preferred embodiments of the portable refrigeration container according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1A:
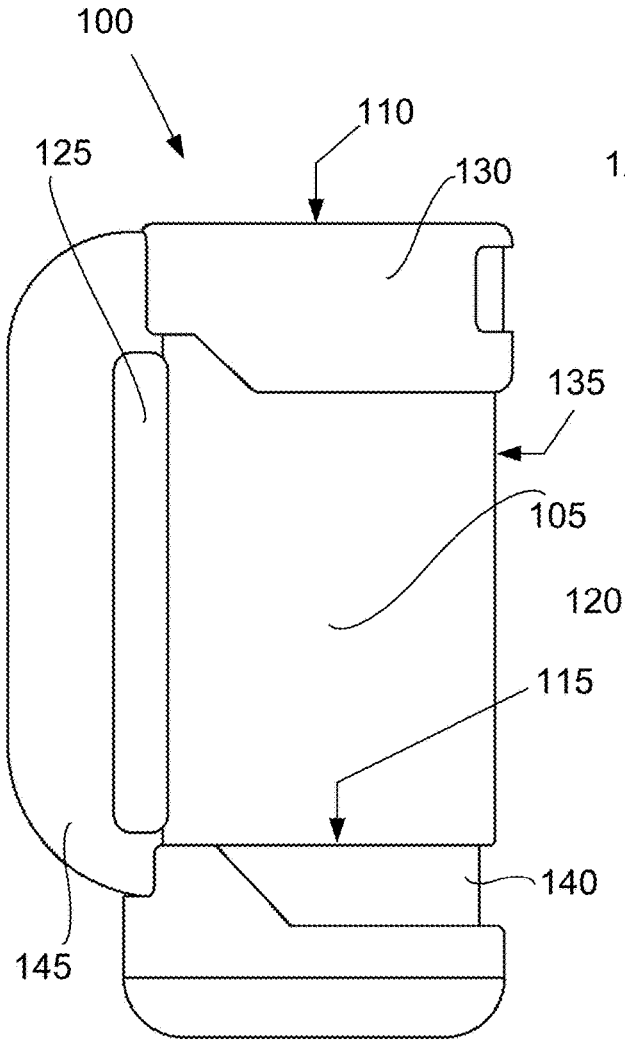
FIG. 1A is a side elevation view of an exemplary portable refrigeration container.
Figure 1B:
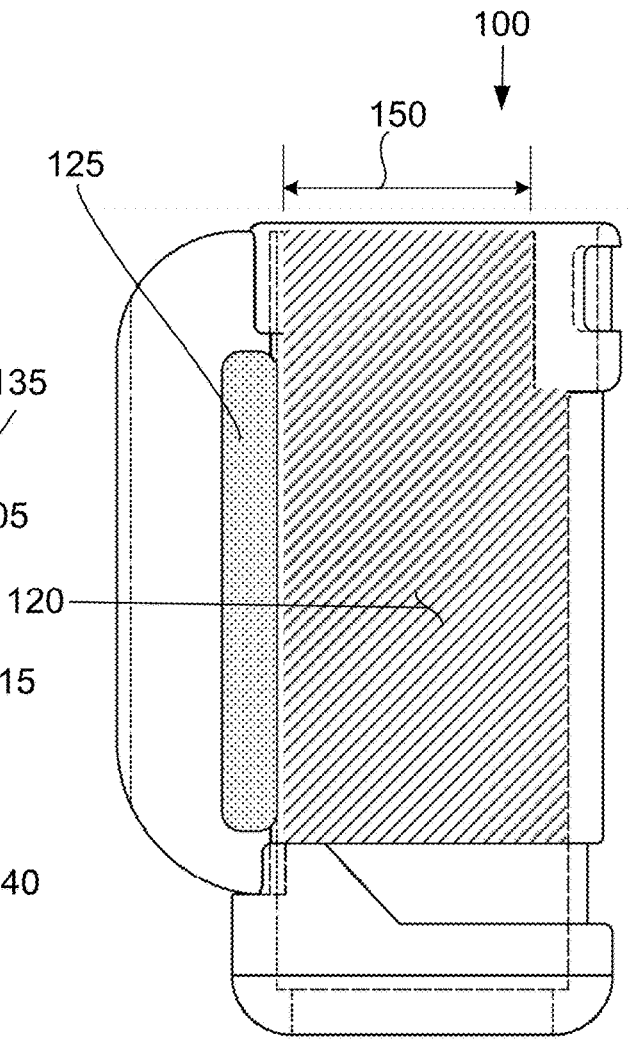
FIG. 1B is a side elevation view thereof showing the inner volume.
Figure 2:
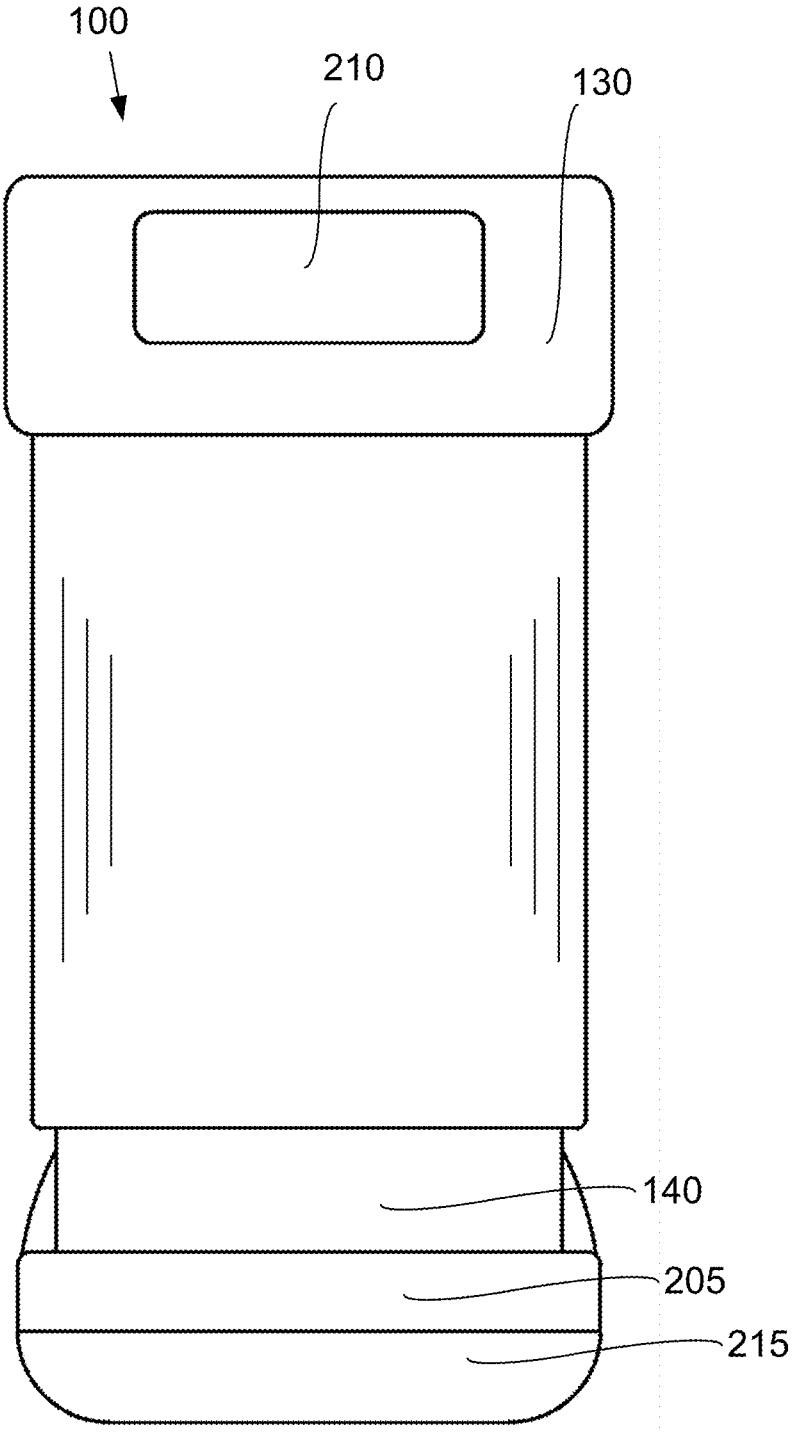
FIG. 2 is a front elevation view thereof.
Figure 3:
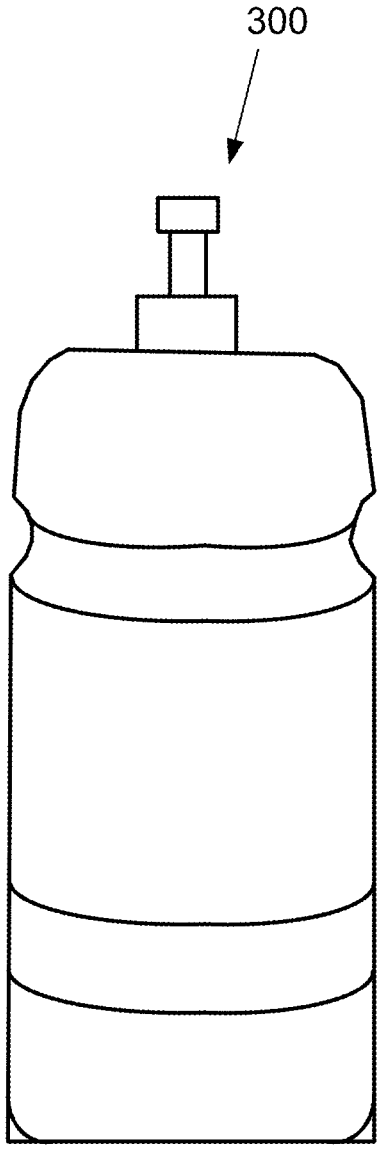
FIG. 3 is a front elevation view of an exemplary drink usable with the preferred portable refrigeration container.

FIG. 1A is a side elevation view of a preferred portable refrigeration container (100). The portable refrigeration container (100) is usable for cooling a drink in a bottle (300) typically used in cycling or any other typical 10 ounce can or typical 20 ounce disposable bottle of drinkable fluid.

The portable refrigeration container (100) includes at least a tubular body (105); a vortex tube (125); an electronic programmable controller (130); a tank (805) of compressed air; a battery (530); a Peltier device (535); a heat exchanger (205); and a removable electrical charging station (1100). Optionally, the portable refrigeration container (100) further includes a compressor (815); a dynamo (810); and a bracket (145) for attachment to a bicycle frame.

The tubular body (105) includes an open top end (110) and a plate (140) that forms a bottom end (115) to an inner volume (120). The plate (140) defines a central through-hole (905) used for receiving the Peltier device (535).

The inner volume (120) of the tubular body (105) is configured to hold the drink, which, as examples, might be water, soda, tea or other popular drinks commonly available in a bottle (300). The inner volume (120) may be in any cross-sectional configuration, such as circular, rectangular, square, and pentagonal. The cross-sectional configuration of the tubular body (105) and/or the inner volume (120) does not have to be circular nor does it have to be of uniform dimension throughout its length. Preferably, tubular body (105) is configured to be the structural support base where other components are attached. The tubular body (105) also provides a thermal insulation between the inner volume (120) and the external environment.

To hold the most commonly available drinks, the inner volume (120) is preferably defined by an open top-end diameter or a width (150) of not less than about 2 inches and a bottom end (115) at not more than about 12 inches from the open top-end. Preferably the width (150) is about 3 inches and preferably, the distance from the bottom end (115) to the open top-end is about 8 inches.

It should be recognized that widths larger than 2 inches and lengths greater than 12 inches will enable larger bottles to be carried, but at the same time will add weight that can be an impediment to users in competitive cycling sports where extra weight can slow down a rider. It is preferable that the width (150) afford some surrounding environment for the cool air within the inner volume.

Figure 5:
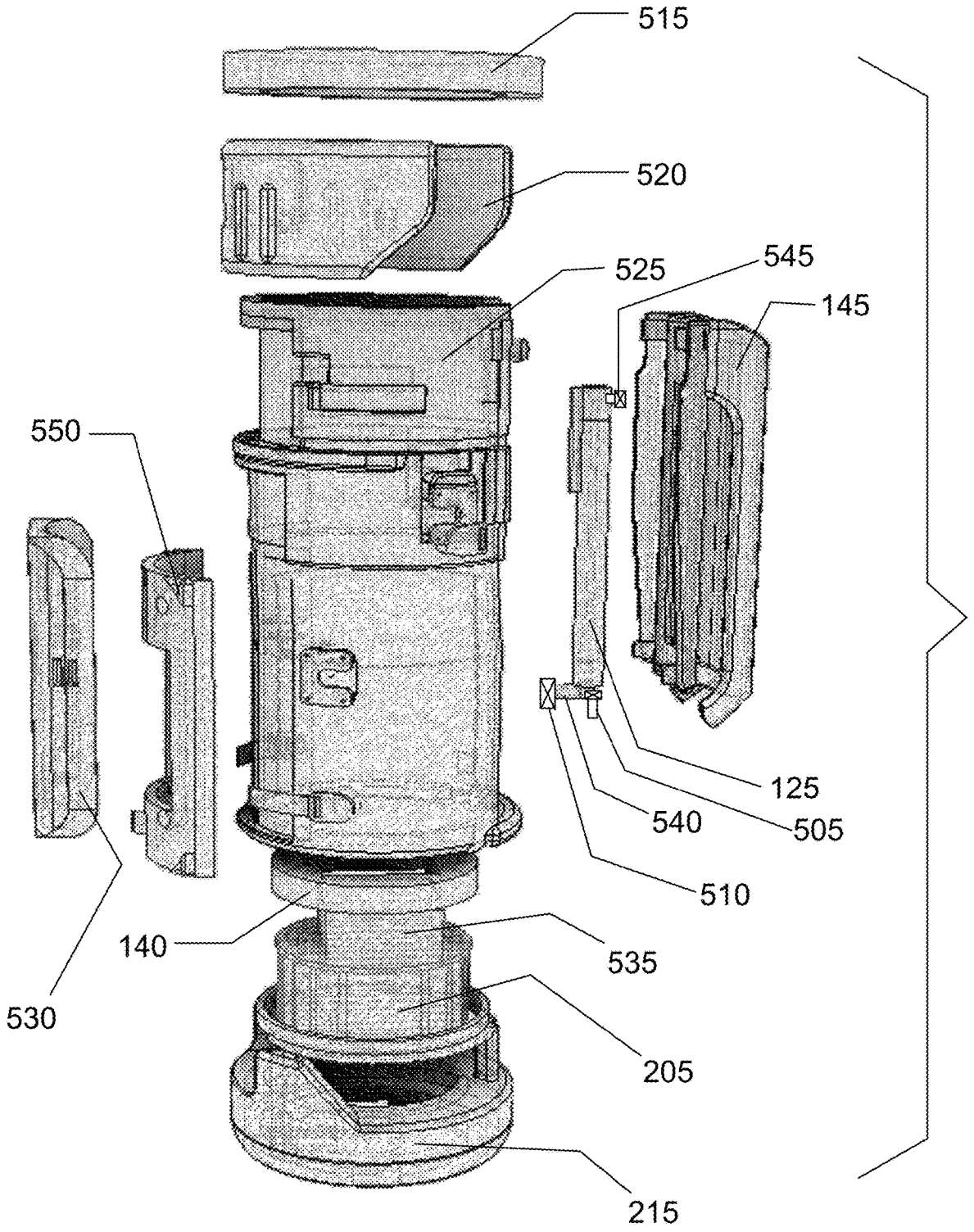
FIG. 5 is an exploded view of the main components of a preferred portable refrigeration container.
Figure 6:
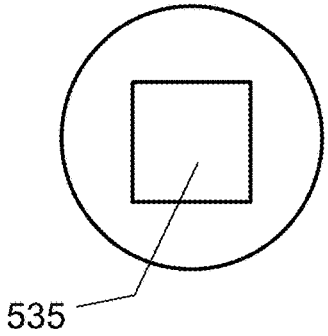
FIG. 6 is a top view of an exemplary plate and Peltier device mounted in a central through-hole.
Figure 7:
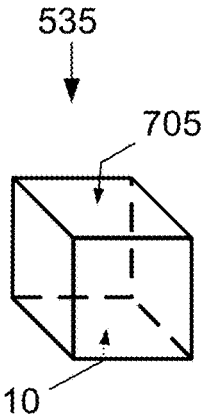
FIG. 7 is the Peltier device illustrating an upper surface and a lower surface thereof.
Figure 9:
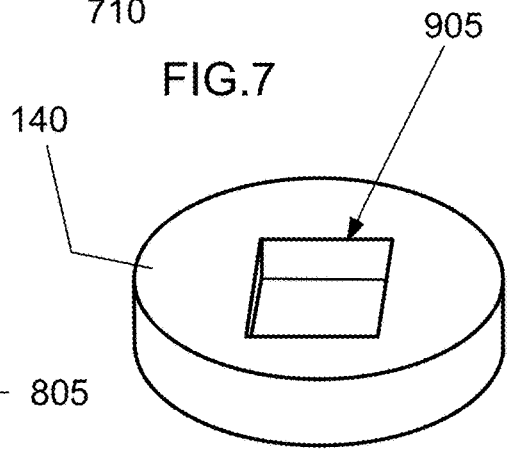
FIG. 9 is a perspective view of the plate illustrating a central through-hole.
Figure 8:
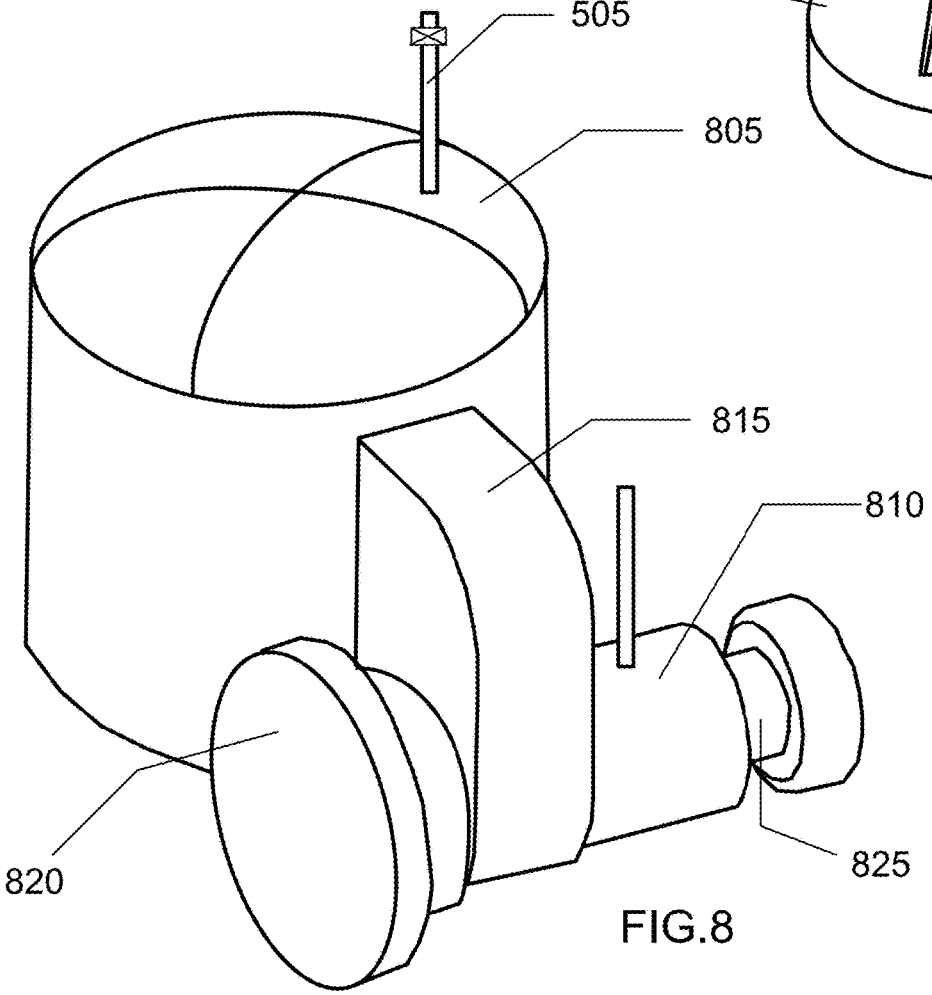
FIG. 8 is a perspective view of an exemplary tank of compressed air and dynamo.

The inner volume (120) is preferably accessible through the open top end (110) for removal and insertion of the bottle (300). While a top cover for the portable refrigeration container (100) may be utilized, it is not preferred because it adds weight and will not help significantly in maintaining a cooling atmosphere in the inner volume (120). Smaller widths are possible, but would be unsuitable for carrying the more commonly available cycling bottles or other cans and bottles. As shown in FIG. 5, a rubber ring (515), may be added around the open top end (110) so that the bottle (300) sits snugly within, inhibiting the release of cold air. The term "rubber" in rubber ring (515) is intended to be interpreted liberally, and include known substitutes such as plastic, silicone, nitrile butadiene, and neoprene.

The vortex tube (125) has a compressed air input line (505), an output cool air line (540) flowably connected to the inner volume (120), and an outlet valve (545) exhausting hot air to an environment outside the tubular body (105).

The electronic programmable controller (130) is operable to open or close a valve (510) on the output cool air line (540) between the vortex tube (125) and the inner volume (120). The electronic programmable controller (130) is preferably a semi-circular ring, namely a control collar (520), which rotatably slides on an outer wall (135) of the tubular body (105) to activate or shut-off the cooling processes of the portable refrigeration container (100). Preferably, a rubber ring (515), may be added around the open top end (110) so that the bottle (300) sits snugly within, inhibiting the release of cold air. Preferably, the portable refrigeration container (100) would be made with more than one rubber ring size to accommodate bottles of different diameters. Alternatively, there are two end-of-stroke buttons configured to be grips to facilitate turning the control collar (520). Preferably, an LED (210) indicates the activation status of the portable refrigeration container (100).

The tank (805) of compressed air is valved so as to permit compressed air to flow from the tank (805) into the compressed air input line (505) as controlled by the electronic programmable controller (130).

The battery (530) is connected to supply electrical power to the electronic programmable controller (130). Preferably, the battery (530) is attached to an outer wall (135) of the tubular body (105), preferably using a battery frame (550). The battery (530) preferably provides 12 volts at 2.6 ampere capacity. The battery (530) is optionally configured with an on/off switch and two Indicator light-emitting diodes (LED) indicators of operational status and/or charge status.

The Peltier device (535) fits within the central through-hole (905) of the plate (140). The Peltier device (535) has an upper surface (705) and a lower surface (710). The upper surface (705) preferably aligns with the top surface of the plate (140) and the lower surface (710) preferably aligns or extends beyond the bottom surface of the plate (140) so that a heat sink can make direct contact with bottom surface and transfer heat from the plate (140) to the environment outside the tubular body (105). The heat sink is preferably a typical finned, passive heat exchanger that transfers the heat generated by the Peltier device (535) to the air environment surrounding the portable refrigeration container (100). The heat is dissipated away from the Peltier device (535), thereby allowing regulation of the temperature of the lower surface (710) of the Peltier device (535) to optimal levels. The fan (215) preferably blows air across the fins to increase the heat transfer rate.

The Peltier device (535) is configured so that, when powered, the upper surface (705) is cooled, which draws heat from the inner volume (120) and sends this heat to the lower surface (710), causing the lower surface (710) to be heated. The upper surface (705) of the Peltier device (535) is part of the bottom end (115) of the inner volume (120). Since the Peltier device (535) functions when electrically powered, it is powered by the battery (530).

The heat exchanger (205) is placed in contact with the lower surface (710) of the Peltier device (535) so as to enhance heat transfer away from the lower surface (710) of the Peltier device (535), improving the operational efficiency of the Peltier device (535).

Figure 4:
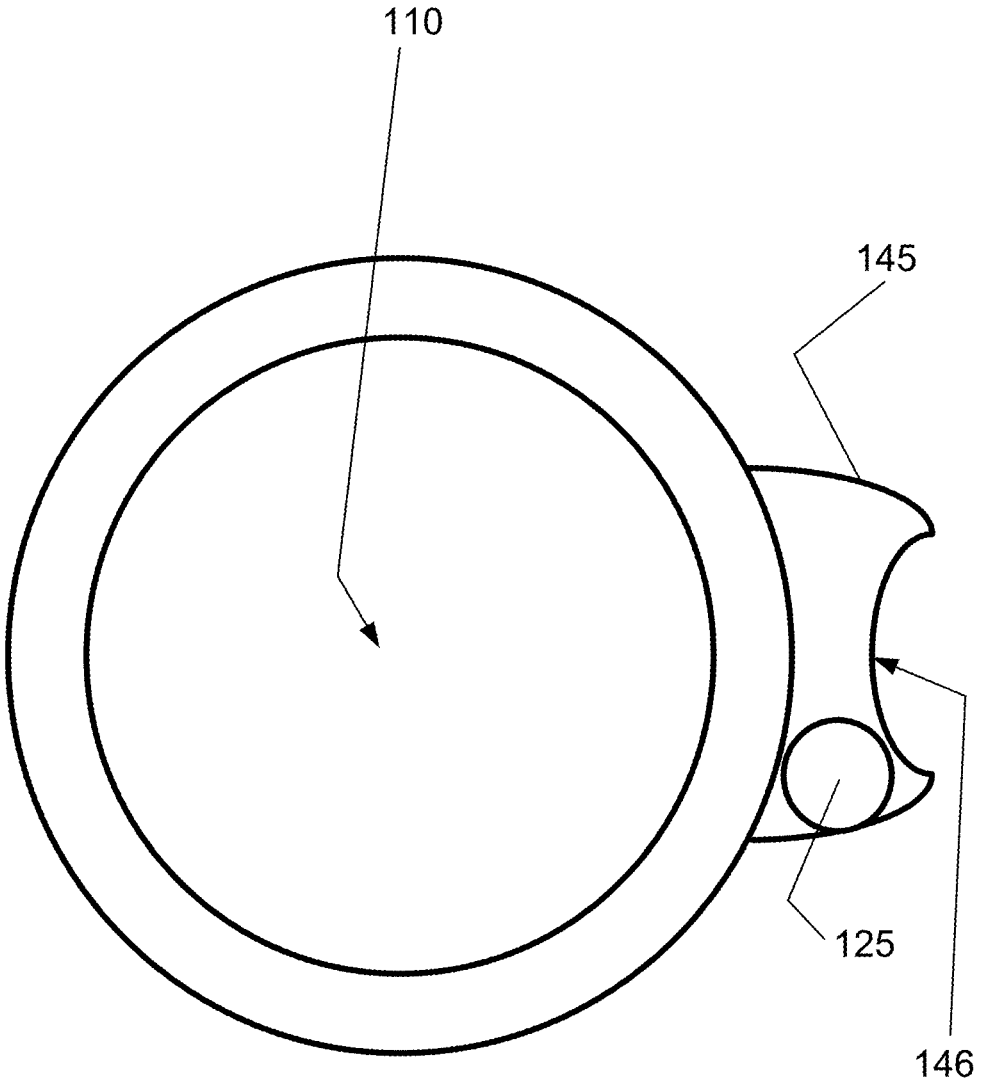
FIG. 4 is a top view of another exemplary portable refrigeration container showing the open top end, the vortex tube, the bracket having a semi-circular face.
Figure 11:
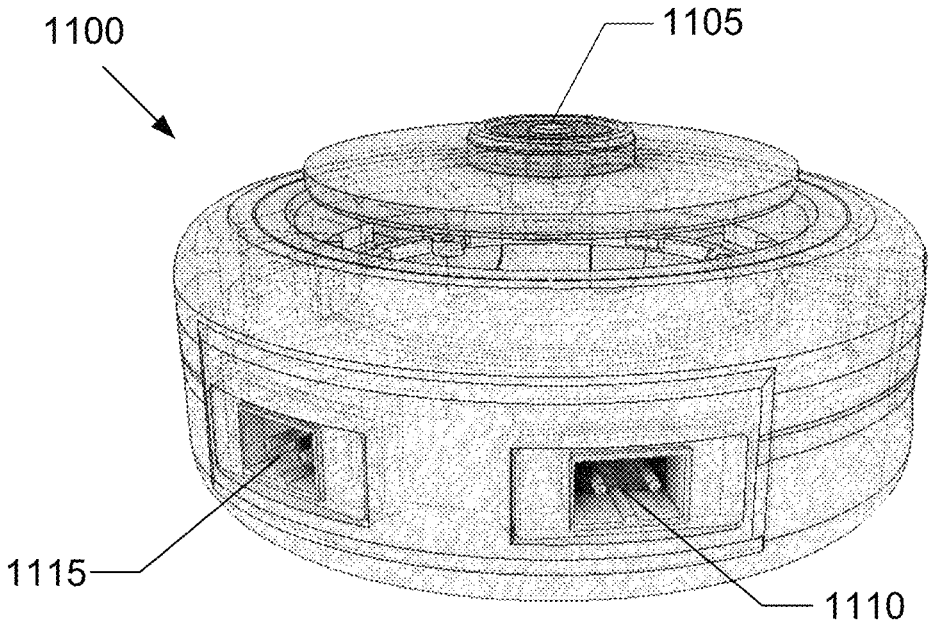
FIG. 11 is a perspective view of an exemplary removable electrical charging station.

The removable electrical charging station (1100), shown in FIG. 11, is preferably situated and connected below the fan (215) when in use and can be disconnected and stored apart from its connection location below the fan (215). The removable electrical charging station (1100) preferably has a first DC output port (1105) centrally located on the top of the removable electrical charging station (1100). The fan (215) has a mating fixture in its lower extremity to receive the first DC output port (1105). Preferably, the removable electrical charging station (1100) has a standard 120 volt AC electrical connection port (1110) and a second 12 volt DC output port (1115), as shown in FIG. 4. The second 12 volt DC output port (1115) may be used for a direct wired connection to the battery (530) configured within the battery frame (550).

The removable electrical charging station (1100) is essentially an AC/DC converter. For U.S. applications, the removable electrical charging station (1100) preferably converts 120 volt AC line voltage to DC at the voltage and current capacity of the battery (530) when charging the battery (530). Thus, the removable electrical charging station (1100) is configured to recharge the battery (530) upon connection to any standard outside electrical supply line. When in another country with different AC electrical standards, the removable electrical charging station (1100) would be configured to operate within those standards.

The portable refrigeration container (100) optionally includes the compressor (815), which supplies compressed air to the tank (805) of compressed air. The compressor (815) may be powered by standard AC line voltage, or optionally may be powered by connection to a bicycle wheel.

Figure 10:
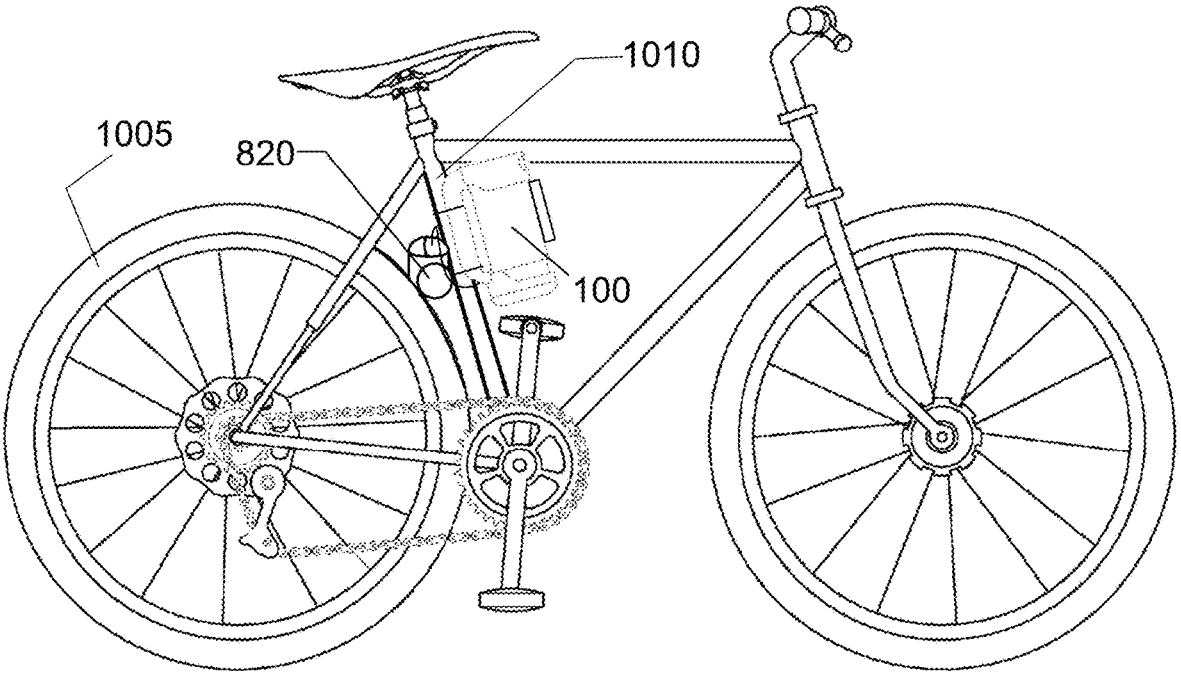
FIG. 10 is a side elevation view of an exemplary portable refrigeration container mounted to the frame of a bicycle.

Preferably, the compressor (815) is powered by connection to a front or rear bicycle wheel. A connection to the rear bicycle wheel (1005) is shown in the exemplary embodiment of FIG. 10. When so connected to a bicycle wheel, then the portable refrigeration container (100) also includes the dynamo (810) that is configured to electrically recharge the battery (530). This is preferably accomplished by having the compressor (815) and the dynamo (810) share a single shaft (825) that is mounted to the bicycle frame (1010) so as to rotate with one of the bicycle wheels. Preferably, a rubber wheel (820) on the single shaft (825) rides against a rear bicycle wheel (1005) and turns as the rear bicycle wheel (1005) rotates. This allows the dynamo (810) to generate electrical energy to recharge the battery (530) and at the same time operate the compressor (815) to supply compressed air to the tank (805). In an alternative embodiment, the compressor (815) and the dynamo (810) is mounted facing forward on a vertical bar of the bicycle frame.

The portable refrigeration container (100) optionally includes the bracket (145) that is attached to the outer wall (135) of the tubular body (105). The bracket (145) is preconfigured to attach the portable refrigeration container (100) to a bicycle frame. The bracket (145), when present secures the vortex tube (125) to the outer wall (135) of the tubular body (105) and protects the vortex tube (125) from accidental damage. Preferably, the bracket (145) has a semi-circular face (146) that mates with a typical bicycle frame for a better fit and easier attachment.

Example of Operation

In a first step, a user charges the portable refrigeration container (100) by rotating the electronic programmable controller (130) to a load/charging position. This energizes an LED (210), indicating a battery charging status. Preferably, battery charging is engaged for about 8 hours for the first time the electronic programmable controller (130) is used.

When the user wants to cool the inner volume (120) and with the removable electrical charging station (1100) attached, the user turns the control collar (520) to a position to cool using the removable electrical charging station (1100). A lightning icon appears, which indicates that cooling is engaged. Once removed from the removable electrical charging station (1100), if cooling is to be continued, then the control collar (520) is reset to operate from battery power.

When the user is ready to set out on a ride on a bicycle, then the portable refrigeration container (100) is attached to the bicycle. Preferably, the single shaft (825) of the compressor (815) and dynamo (810) is rotatably connected to turn with the rear bicycle wheel (1005) to keep the battery (530) charged and the tank (805) filled with compressed air.

In this example, the vortex tube (125) cools the contents of the inner volume (120) and the Peltier device (535) maintains the contents up to 15 degrees below the ambient temperature. The user can remove the drink from the inner volume (120) and drink from the bottle (300) whenever desired.

The control module (525) enables the user to monitor the energy and air pressure levels. This way, the user can manage the consumption of the portable cooling system according to the effort made.

The user may recharge the battery (530) and tank (805) using either the removable electrical charging station (1100) and the compressor (815) or through continued use of the bicycle with the single shaft (825) for the compressor (815) and dynamo (810).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the refrigeration industry.

What is claimed is:

1. A portable refrigeration container usable for cooling a bottle of drinkable fluid, the portable refrigeration container comprising:

a tubular body comprising: the open top-end; and a plate forming the bottom end, the plate defining a central through-hole;

the tubular body having an inner volume defined by an open top-end with a width of not less than 2 inches and a bottom end at not more than 12 inches from the open top-end, the inner volume accessible through the open top-end for removal and insertion of the bottle;

a vortex tube comprising a compressed air input line, an output cool air line flowably connected to the inner volume; and an outlet valve exhausting hot air to an environment outside the tubular body;

an electronic programmable controller operable to open or close a valve on the output cool air line between the vortex tube and the inner volume;

a tank of compressed air valved so as to permit compressed air to flow from the tank into the compressed air input line as controlled by the electronic programmable controller;

a battery connected to supply electrical power to the electronic programmable controller;

a Peltier device fitting within the central through-hole of the plate, the Peltier device comprising an upper surface and a lower surface, the Peltier device configured so that, when powered, the upper surface is cooled and the lower surface is heated, wherein the upper surface comprises a part of the bottom end of the inner volume, the Peltier device powered by the battery;

a heat exchanger in contact with the lower surface of the Peltier device so as to enhance heat transfer away from the lower surface of the Peltier device; and, a removable electrical charging station situated below a fan and configured to recharge the battery upon connection to an outside electrical supply line.

2. The portable refrigeration container of claim 1, further comprising a compressor configured to supply compressed air to the tank of compressed air.

3. The portable refrigeration container of claim 1, further comprising:

a compressor configured to supply compressed air to the tank of compressed air;

a dynamo configured to electrically recharge the battery; and wherein the compressor and the dynamo share a single shaft that is rotatably connected to turn with a bicycle wheel.

4. The portable refrigeration container of claim 1, further comprising a bracket attached to an outer wall of the tubular body, the bracket configured to attach the portable refrigeration container to a bicycle frame.

5. The portable refrigeration container of claim 1, wherein the battery is attached to an outer wall of the tubular body.

* * * * *